US006731159B2

(12) United States Patent
Van Zanten et al.

(10) Patent No.: US 6,731,159 B2
(45) Date of Patent: May 4, 2004

(54) MIRRORING CIRCUIT FOR OPERATION AT HIGH FREQUENCIES

(75) Inventors: Francois Van Zanten, Meylan (FR); Marc Sabut, Eybens (FR); Raymond Ribas, Saint Martin de la Cluze (FR)

(73) Assignee: STMicroelectronics S.A., Montrouge (FR)

( * ) Notice: Subject to any disclaimer, the term of this patent is extended or adjusted under 35 U.S.C. 154(b) by 0 days.

(21) Appl. No.: 10/299,159

(22) Filed: Nov. 18, 2002

(65) Prior Publication Data

US 2003/0094999 A1 May 22, 2003

(30) Foreign Application Priority Data

Nov. 19, 2001 (FR) ..... 01 14926

(51) Int. Cl.[7] ..... G05F 3/26; H03K 5/22

(52) U.S. Cl. ..... 327/543; 327/66; 327/562; 327/108; 330/257; 323/315

(58) Field of Search ..... 327/53, 66, 108, 327/538, 543, 562, 563; 330/257, 288, 292; 323/315, 316

(56) References Cited

U.S. PATENT DOCUMENTS 5,469,092 A 11/1995 Itakura ..... 323/315
5,497,074 A * 3/1996 Boezen ..... 323/316
5,889,431 A 3/1999 Csanky ..... 327/543
5,969,574 A * 10/1999 Legates ..... 330/288

OTHER PUBLICATIONS

French Preliminary Search Report dated Aug. 29, 2002 for French Application No. 01 14926.

* cited by examiner

*Primary Examiner*—Timothy P. Callahan
*Assistant Examiner*—Terry L. Englund
(74) *Attorney, Agent, or Firm*—Lisa K. Jorgenson; Stephen Bongini; Gutman, Bongini & Bianco P.L.

(57) ABSTRACT

A mirroring circuit operating at high frequencies is provided. The mirroring circuit includes a first branch having a first transistor in series with a first resistor, a second branch having a second transistor in series with a second resistor, and a servo circuit for controlling current flowing in the first branch and the second branch. The servo circuit includes a third transistor configured as a diode, a source of the third transistor coupled to a source of the first transistor, a fourth transistor configured as a shift lever, a source of the fourth transistor coupled to ground via a third resistor, a fifth transistor configured as a diode, a source of the fifth transistor coupled to a source of the second transistor, and a sixth transistor configured as a shift lever, a source of the sixth transistor coupled to ground via the third resistor.

21 Claims, 3 Drawing Sheets

MIRRORING CIRCUIT FOR OPERATION AT HIGH FREQUENCIES

CROSS-REFERENCE TO RELATED APPLICATIONS

This application is based upon and claims priority from French Patent Application No. 01 14926, filed Nov. 19, 2001, the entire disclosure of which is herein incorporated by reference.

BACKGROUND OF THE INVENTION

1. Field of the Invention

The present invention relates to the field of electronic circuits, and more specifically to current mirroring circuits that can operate at high frequencies.

2. Description of Related Art

Current mirroring circuits are transistor assemblies typically used in electronics and for realizing amplifiers. As is well known in the art, a mirroring circuit allows the duplication of a current existing in a first branch of a circuit, into a second, a third or an nth branch of the circuit.

FIG. 1 is a diagram showing the conventional architecture of a current mirroring circuit, including stray capacitances of the MOS transistors. A MOS-type transistor (with an N-type channel, for example) is assembled as a diode, in which flows a current $I_{ref}$ generated by a current source 4. Two identical N channel transistors 2 and 3 have their source electrodes connected to ground and their gates connected to the gate of transistor 1. As transistors 2 and 3 are identical and are subjected to the same control voltage $V_{gs}$, the same current $I_o$ flows through transistors 2 and 3. With regard to the respective physical characteristics of transistors 1, 2, and 3, FIG. 1 illustrates a transistor 1 having a channel length L and a channel width W1. Similarly, transistors 2 and 3 have a channel length L and a channel width W2.

It is known that the relationship between the current flowing inside the current source $I_{ref}$ and the current flowing in transistors 2 and 3 is given as:

$$I_o/I_{ref}=W2/W1$$

It is thus seen that duplicating currents between transistor 1 and both transistors 2 and 3 is realized according to a ratio that is defined by the channel widths of the transistors. Current duplication, and in particular the precision of this duplication, thus depends on the precision of the manufacturing process for obtaining precise physical dimensions.

In order to realize an adequate pairing of transistors 2 and 3, transistors having high values of L and W (and thus having large physical dimensions) must be used. This results in stray capacitances of non-negligible values since the values are proportional to the area W2×L that the transistor covers on the silicon substrate. FIG. 1 symbolically represents these stray capacitances that are connected between the various electrodes of the transistor. There is a capacitance between the gate and the source, the gate and the drain, and the drain and the source of each of transistors 2 and 3.

The appearance of such stray capacitances is prejudicial to operation of the current mirror at high frequencies, which creates a dilemma. Either the size of the transistors, and consequently the values of the stray capacitances, are reduced, thus allowing for high frequency operation and less precise current duplication, or operation at high frequency is yielded and the area occupied by transistors is increased to ensure adequate current duplication.

Therefore, a need exists to overcome the problem of current mirroring circuit precision during high frequency operation.

SUMMARY OF THE INVENTION

In view of these drawbacks, it is an object of the present invention to overcome the above-mentioned drawbacks and to provide a current mirroring structure allowing for a high degree of accuracy in current duplication while allowing operation at high frequencies.

Another object of the present invention is to realize an amplifier structure that is usable at high frequency and equipped with a precise mirroring circuit.

One embodiment of the present invention provides a mirroring circuit including a first branch having a first transistor in series with a first resistor and a second branch having a second transistor in series with a second resistor. The mirroring circuit further includes a servo circuit for controlling current flowing in the first branch and the second branch. The servo circuit includes a third transistor mounted as a diode, a source of the third transistor connected to a source of the first transistor and a drain and a gate of the third transistor connected to a first power source, which generates a first reference current. The servo circuit further includes a fourth transistor having its source connected to ground via a third resistor, its gate connected to the gate of the third transistor and its drain connected to a gate of the first transistor and to a second power source, which generates a second reference current. The servo circuit further includes a fifth transistor mounted as a diode, a source of the fifth transistor connected to a source of the second transistor and a drain and a gate of the fifth transistor connected to a third power source, which generates a third reference current. The servo circuit further includes a sixth transistor having its source connected to ground via the third resistor, its gate connected to the gate of the fifth transistor and its drain connected to a gate of the second transistor and to a fourth power source, which generates a fourth reference current.

Another embodiment of the present invention provides an amplifier circuit that includes a first differential stage, and a Miller gain stage having two outputs coupled to two outputs of the amplifier circuit. The Miller gain stage is supplied by a mirror current source that includes a first branch having a first transistor in series with a first resistor, a second branch having a second transistor in series with a second resistor, and a servo circuit for controlling current flowing in the first branch and the second branch. The servo circuit includes a third transistor configured as a diode, a source of the third transistor being coupled to a source of the first transistor, and a drain and a gate of the third transistor being coupled to a first source generating a first reference current. The servo circuit also includes a fourth transistor having its source coupled to ground via at least a third resistor, its gate coupled to the gate of the third transistor, and its drain coupled to a gate of the first transistor and to a second source generating a second reference current. The servo circuit also includes a fifth transistor configured as a diode, a source of the fifth transistor being coupled to a source of the second transistor, and a drain and a gate of the fifth transistor being coupled to a third source generating a third reference current. The servo circuit also includes a sixth transistor having its source coupled to ground via at least the third resistor, its gate coupled to the gate of the fifth transistor, and its drain coupled to a gate of the second transistor and to a fourth source generating a fourth reference current.

Other objects, features and advantages of the present invention will become apparent from the following detailed description. It should be understood, however, that the detailed description and specific examples, while indicating preferred embodiments of the present invention, are given by way of illustration only and various modifications may naturally be performed without deviating from the present invention.

DETAILED DESCRIPTION OF PREFERRED EMBODIMENTS

Figure 1:
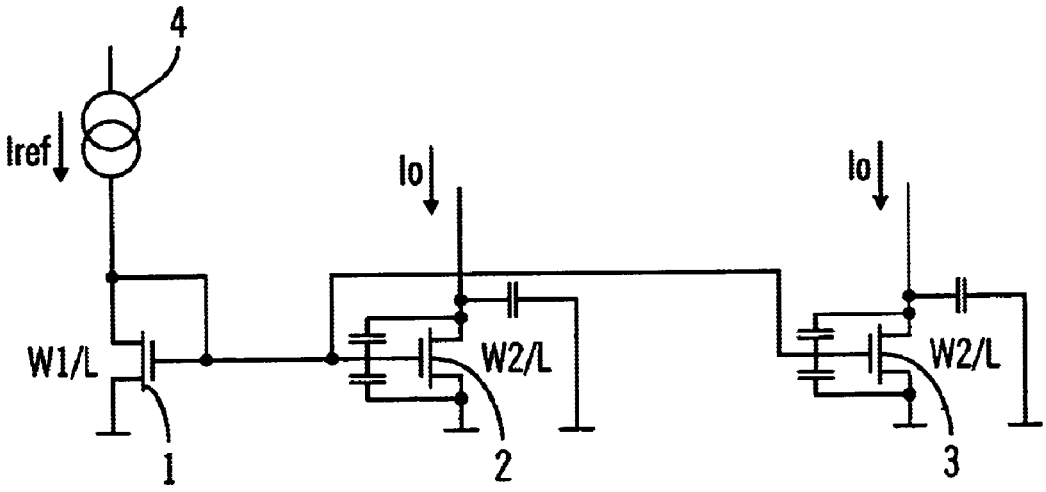
FIG. 1 PRIOR ART
FIG. 1 is a diagram illustrating the conventional architecture of a current mirroring circuit, including stray capacitances of the MOS transistors.

Preferred embodiments of the present invention will be described in detail hereinbelow with reference to the attached drawings.

Preferred embodiments of the present invention provide a mirroring circuit including a first branch having a first transistor in series with a first resistor and a second branch having a second transistor in series with a second resistor. The mirroring circuit further includes a servo circuit for controlling current flowing in the first branch and the second branch.

The servo circuit includes a third transistor mounted as a diode, a source of the third transistor connected to a source of the first transistor and a drain and a gate of the third transistor connected to a first power source, which generates a first reference current. The servo circuit further includes a fourth transistor mounted as a shift lever, a source of the fourth transistor connected to ground via a third resistor, a gate of the fourth transistor connected to the gate of the third transistor and a drain of the fourth transistor connected to a gate of the first transistor and to a second power source, which generates a second reference current. The servo circuit further includes a fifth transistor mounted as a diode, a source of the fifth transistor connected to a source of the second transistor and a drain and a gate of the fifth transistor connected to a third power source, which generates a third reference current. The servo circuit further includes a sixth transistor mounted as a shift lever, a source of the sixth transistor connected to ground via the third resistor, a gate of the sixth transistor connected to the gate of the fifth transistor and a drain of the sixth transistor connected to a gate of the second transistor and to a fourth power source, which generates a fourth reference current.

Another embodiment of the present invention provides a mirroring circuit including a first branch having a first transistor with a source electrode, a drain electrode and a gate electrode, the source electrode of the first transistor connected to a first electrode of a first resistor having a second electrode connected to a first reference voltage. The mirroring circuit further includes a second branch including a second transistor having a source electrode, a drain electrode and a gate electrode, the source electrode of the second transistor connected to a first electrode of a second resistor having a second electrode connected to the first reference voltage. The mirroring circuit further includes a servo circuit controlling a source voltage of the first transistor and the second transistor.

The servo circuit includes a third transistor having a source electrode, a drain electrode and a gate electrode, the source electrode of the third transistor connected to the source electrode of the first transistor, and the gate electrode and the drain electrode of the third transistor connected to a first power source, which generates a first reference current. The servo circuit further includes a fourth transistor having a source electrode, a drain electrode and a gate electrode, the source electrode of the fourth transistor connected to a first electrode of a third resistor having a second electrode connected to a second reference voltage, the gate electrode of the fourth transistor connected to the gate electrode of the third transistor and the drain electrode of the fourth transistor connected to the gate electrode of the first transistor and to a second power source, which generates a second reference current equal to the first reference current.

The servo circuit further includes a fifth transistor having a source electrode, a drain electrode and a gate electrode, the source electrode of the fifth transistor connected to the source electrode of the second transistor, and the gate electrode and the drain electrode of the fifth transistor connected to a third power source, which generates a third reference current equal to the first reference current and the second reference current. The servo circuit further includes a sixth transistor having a source electrode, a drain electrode and a gate electrode, the source electrode of the sixth transistor being connected to the first electrode of the third resistor, the gate electrode of the sixth transistor connected to the gate electrode of the fifth transistor, and the drain electrode of the sixth transistor connected to the gate electrode of the second transistor and to a fourth power source, which generates a fourth reference current equal to the first reference current, the second reference current and the third reference current. Further, the third transistor and the fourth transistor have substantially identical Vgs characteristics for regulating current in the first branch and the second branch. Preferentially, the first and second transistors have low stray capacitances, allowing operation at high frequencies.

One illustrative embodiment of the present invention provides an amplifier circuit having two input electrodes, two output electrodes and a first differential stage. The amplifier circuit also includes a second Miller gain stage having its outputs connected to the output electrodes. The second stage is fed by a mirror current source including a first branch having a first transistor in series with a first resistor and a second branch including a second transistor in series with a second resistor. A servo circuit makes it possible to maintain the currents flowing in both branches to an equal value. The servo circuit includes a third transistor mounted as a diode, having its source connected to the source of the first transistor, and having its drain and gate electrodes connected to a first power source generating a reference current. The servo circuit further includes a fourth transistor mounted as a shift lever and having its source connected to ground via a third resistor having a gate electrode connected to the gate electrode of the third transistor and a drain electrode connected to the gate electrode of the first transistor and to a second power source generating the reference current. The servo circuit further includes a fifth transistor mounted as a diode and having a source electrode connected to the source of the second transistor and having its drain and gate electrodes connected to a third power source generating the reference current. The servo circuit further includes a sixth transistor mounted as a shift lever, having its source electrode connected to ground via said third resistor having a gate connected to the gate of the fifth transistor and a drain connected to the gate of the second transistor and to a power source.

Exemplary embodiments of the present invention will now be described in detail with reference to FIGS. 2 and 3.

Figure 2:
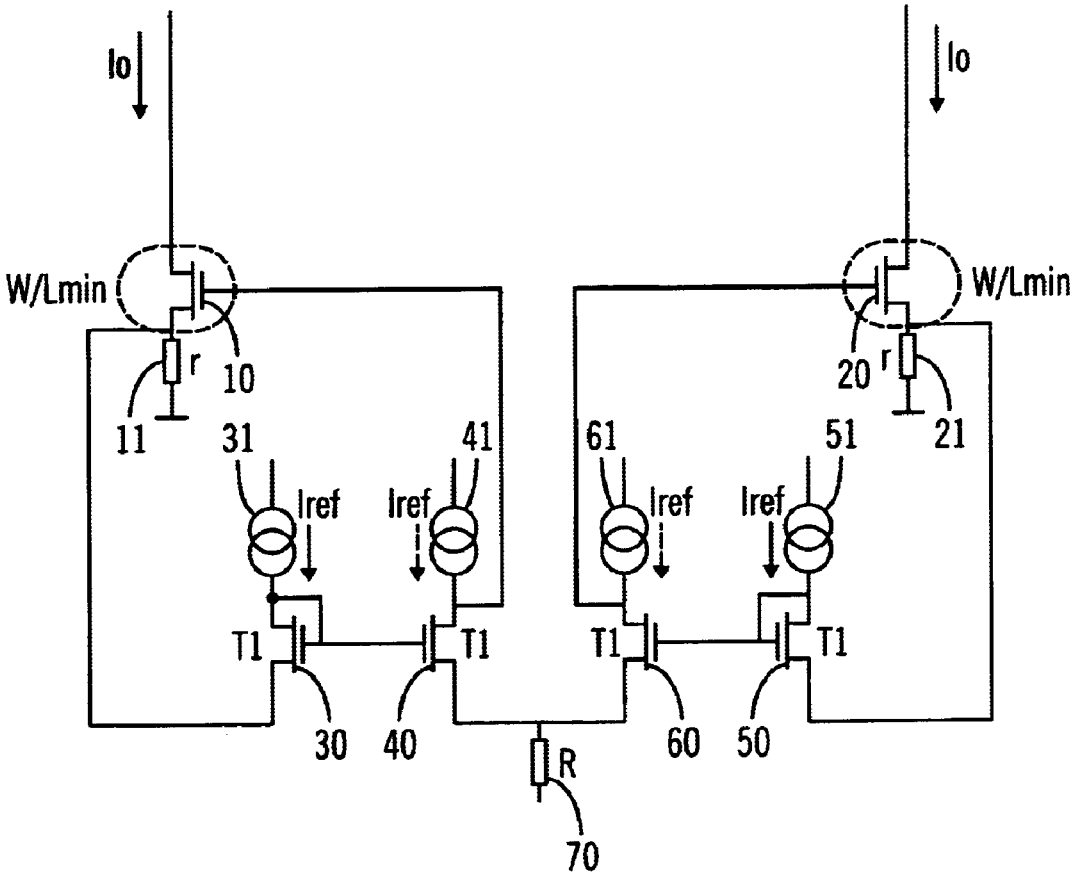
FIG. 2 is a diagram illustrating a current mirroring circuit having a low output capacitance and allowing high-speed operation, in accordance with one embodiment of the present invention.

FIG. 2 shows a diagram of a current mirroring circuit having a low output capacitance and allowing high-speed operation, in accordance with one embodiment of the present invention. This circuit provides a reduction in stray capacitances while allowing high frequency operation. FIG. 2 is described with reference to Metal Oxide Silicon (MOS) transistors of a given channel-type (for example, N-type channel for an NMOS transistor). However, a person of ordinary skill in the art would be able to easily adapt the illustrated current mirroring circuit to realize a dual structure, formed by other types of transistors. Similarly, a current mirroring circuit for duplicating a current on two distinctive branches is described. However, a person of ordinary skill in the art would be able to easily adapt the illustrated current mirroring circuit to duplicate current on three, four or more branches.

In the embodiment of FIG. 2, the, first branch of the current mirroring circuit includes a first NMOS transistor 10 having its source connected to a reference voltage (ground, for example) via a first resistor 11. First NMOS transistor 10 is preferably selected so as to have minimal geometry features and, consequently, minimal stray capacitances. The second branch of the current mirroring circuit includes a second NMOS transistor 20, of the same type as the first NMOS transistor 10, having its source connected to a first electrode of a resistor 21, which has a second electrode connected to a reference voltage (ground, for example). Similarly, second NMOS transistor 20 is selected so as to have negligible stray capacitances. Both transistors 10 and 20 are thus chosen so as to allow operation at high frequency. However, as mentioned previously, the geometrical features alone of transistors 10 and 20 would not ensure perfect pairing and, consequently, precise duplication of current $I_o$. Precise duplication of current $I_o$ is ensured by an additional servo circuit, based in the illustrated embodiment on the use of a third transistor 30, a fourth transistor 40, a fifth transistor 50 and a sixth transistor 60.

Third transistor 30 is an N channel MOS-type transistor, mounted as a diode (i.e., the gate electrode of third transistor 30 is connected to its drain electrode). Furthermore, the drain electrode receives a current $I_{ref}$ generated by a power source 31. The source of transistor 30 is connected to the source of first NMOS transistor 10 as well as to the first electrode of resistor 11. Fourth transistor 40 is an N channel MOS-type transistor that is mounted as a shift lever. For this purpose, the drain electrode of fourth transistor 40 receives a reference current, $I_{ref}$, which is equal to the current provided by source 41. Transistor 40 has a source electrode that is connected to a first terminal of a resistor 70, which has a second terminal connected to a reference voltage (ground, for example). The gate of fourth transistor 40 is connected to the gate of third transistor 30.

Fifth transistor 50 is an N channel MOS-type transistor, mounted as a diode (i.e., the gate electrode of fifth transistor 50 is connected to its drain electrode). The drain electrode of fifth transistor 50 also receives a current, $I_{ref}$, generated by a power source 51. The source of transistor 50 is connected to the source of the second transistor 20, as well as to the first electrode of resistor 21. Sixth transistor 60 is a MOS-type transistor (of the same type as the third transistor 30, fourth transistor 40 and fifth transistor 50) that is mounted as a shift lever. The drain electrode of sixth transistor 60 receives a reference current, $I_{ref}$, which is equal to the current provided by source 61. Sixth transistor 60 has a source electrode that is connected to the first terminal of resistor 70. The gate electrode of sixth transistor 60 is connected to the gate electrode of fifth transistor 50.

Preferably, power sources 31, 41, 51 and 61 must deliver the same current, $I_{ref}$. Techniques used to realize four or more power sources generating an identical current are well known in the art. The physical geometry of transistors 10 and 20 do not constitute a limitation for realizing the four or more power sources generating an identical current. With regards to the third transistor 30, the fourth transistor 40, the fifth transistor 50 and the sixth transistor 60, these transistors are preferably selected so as to have large geometrical features L in order to ensure a good duplication of currents in their respective channels.

The operation of the circuit of FIG. 2 will now be explained. If the second terminals of resistors 11, 21 and 70 are grounded, as shown in FIG. 2, the following relationship is true:

$$r(I_o+I_{ref})=2R\ I_{ref}$$

This relationship results from the fact that both transistors 30 and 40 (corresponding to transistors 50 and 60, respectively) have an identical voltage Vgs. This is true because both transistors 30 and 40 are energized by the same current, and have an identical geometry, and thus are perfectly paired. In most cases, the value of current $I_o$ can be considered higher (by a factor of about 100) than the value of the reference current $I_{ref}$. As a result, the relationship above becomes:

$$I_o=2\ R/r\ I_{ref}$$

Thus, the value R of resistor 70 is preferably much higher than the value r of resistor 11 (corresponding to resistor 21) and current duplication precision becomes exclusively dependent on the precision brought by the values of both resistors R and r.

FIG. 2 also shows the control applied on current $I_o$. If it is assumed that the current in the first branch tends to decrease compared to the current in the second branch, then, the voltage difference on the terminals of resistor 11 will decrease and, consequently, the voltage of the source of NMOS transistors 10 and 30 also decreases. Assuming that the current $I_{ref}$ flowing in transistor 30 is constant, the gate voltage of transistor 30 also decreases. As the source voltage of the fourth transistor 40 is fixed to a constant voltage (i.e., 2 R $I_{ref}$), the drain voltage of transistor 40 tends to increase, which increases the gate voltage of the first transistor 10. The first transistor 10 then tends to increase the current $I_o$ flowing in resistor r to control the value of current $I_o$. The same effect is noted if the current in the second branch tends to decrease. In this case, there would be an increase of the gate voltage of the second transistor 20 due to the decrease in the gate voltage of the fifth and sixth transistors 50 and 60. As a result, the current $I_o$ is regulated, as described above.

Thus, current $I_o$ can be controlled, which allows precise duplication of the current $I_o$ by means of transistors 30–60. Transistors 30–60 have geometrical characteristics implying the appearance of stray capacitances that do not interfere with the operation of transistors 10 and 20, which have small stray capacitances in order to allow operation at high frequencies. Thus, the circuit of the present invention circumvents the former dilemma, wherein either the size of the transistors is reduced to allow for high frequency operation and less precise current duplication, or operation at high frequency is yielded and the area occupied by the transistors is increased to ensure adequate current duplication. The circuit of the present invention allows for efficient amplifier circuits, operating at high frequency and allowing precise current duplication.

Figure 3:
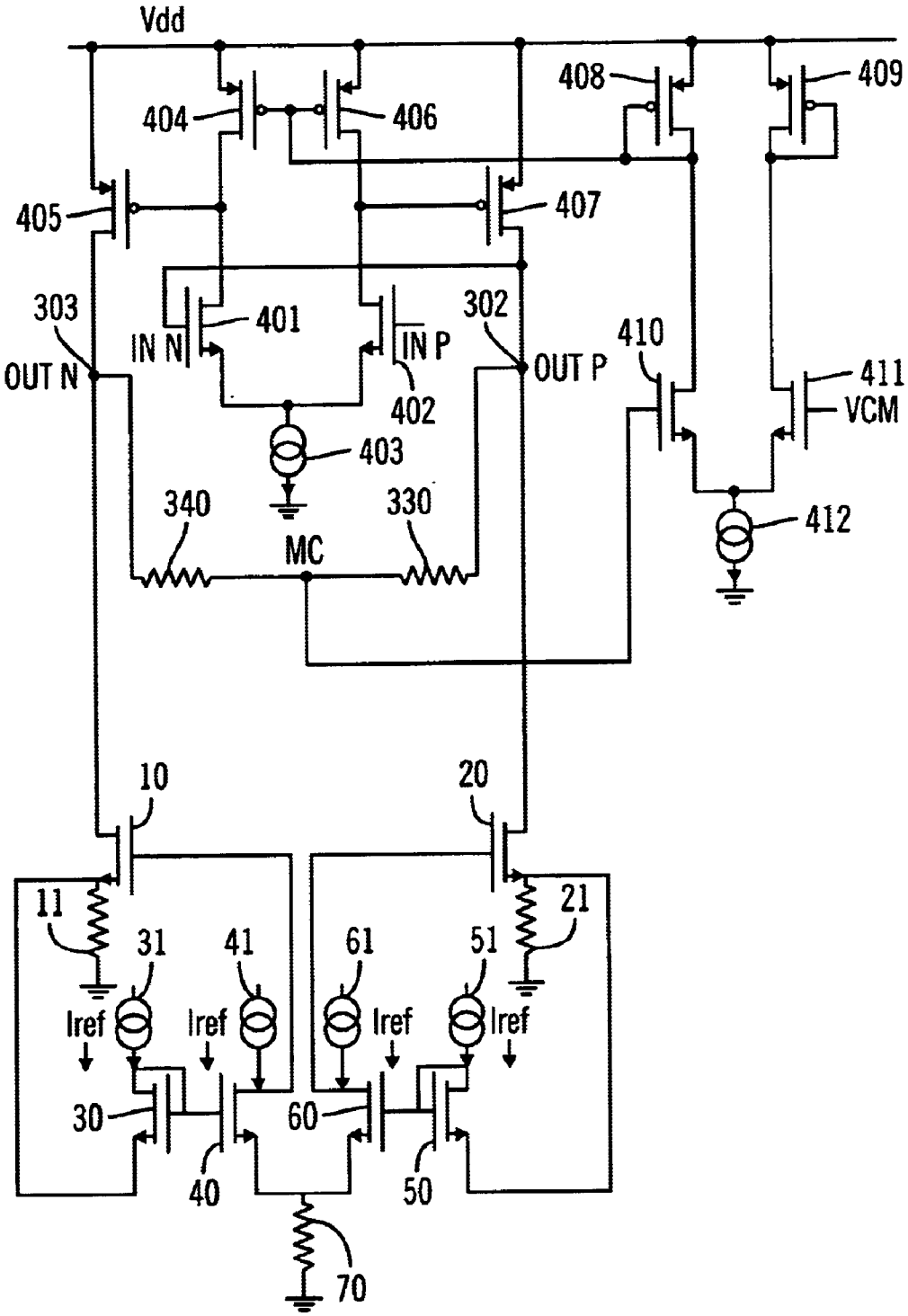
FIG. 3 is a diagram illustrating the application of the current mirroring circuit of FIG. 2 to the realization of a differential amplifier structure.

FIG. 3 shows an example of an integration of the current mirroring circuit of FIG. 2 in a differential amplifier structure for operation at high frequency. The differential amplifier of FIG. 3 includes a differential structure based on a pair of NMOS-type transistors 401 and 402. In this embodiment the differential pair includes NMOS-type transistors. However, one of ordinary skill in the art would be able to directly adapt the structure to an architecture in which the differential pair is based on PMOS-type transistors. With regard to the illustrated embodiment, the amplifier is fed by a power source supplying a voltage Vdd. The source electrodes of NMOS transistors 401 and 402 are connected to a power source 403, the other end of which is connected to ground. Each transistor of the differential pair 401–402 is supplied via its drain electrode by a power source, based on a P channel MOS-type transistor 404 and on a P channel MOS-type transistor 406, respectively, mounted in the current mirroring circuit. The source and drain of transistor 404 (corresponding to transistor 406) are respectively connected to the supply terminal Vdd and to the drain of transistor 401 (corresponding to transistor 402).

Transistors 404 and 406 are mounted in the current mirroring circuit. Transistors 404 and 406 cooperate with a common mode manager stage including a second differential pair associated with a power source 412 and two PMOS-type transistors 408 and 409. Specifically, the second differential pair includes two transistors 410 and 411 having sources connected to a power source 412 having its other end connected to ground. The drain of transistor 410 (corresponding to transistor 411) is connected to the drain of transistor 408 (corresponding to transistor 409), which has its source connected to supply terminal Vdd. The gate of transistor 410 is connected to the midpoint of a resistive bridge, including two identical resistors 340 and 330, having their ends connected to the output terminals OUTN (terminal 303) and OUTP (terminal 302) of the differential structure. The resistive bridge 340–330 is used to obtain, at its midpoint MC, a voltage that is representative of the common mode value of outputs OUTP and OUTN of the differential amplifier. The gate of transistor 411 receives a clamp value voltage Vcm that is used to regulate the polarization level of the common mode stage.

The gate electrodes of transistors 408, 404 and 406 are connected together. The gate electrode of transistor 408 is also connected to the drain electrode of transistor 408, ensuring that transistor 408 operates within the square zone of its characteristic I ($V_{GS}$). Thus the transistors 408, 404 and 406 are mounted in the current mirror circuit and identical drain current flows through transistors 408, 404 and 406 since, as the transistors are substantially identical, the transistors undergo the same variations of gate-source voltage $V_{GS}$. The differential pair made of transistors 401 and 402 is a first stage for a second gain stage (a Miller-type stage), including a pair of PMOS-type transistors 405 and 407 that are assembled as a common source and are supplied by two current mirroring sources (shown in the circuit of FIG. 3). Specifically, the drain of transistor 401 (corresponding to transistor 402) is connected to the gate of transistor 405 (corresponding to transistor 407), which has its source connected to supply terminal Vdd. The drains of transistors 405 and 407 are connected to the drain of the first and the second transistors (10, 20) of the mirroring circuit, respectively.

While there has been illustrated and described what are presently considered to be the preferred embodiments of the present invention, it will be understood by those skilled in the art that various other modifications may be made, and equivalents may be substituted, without departing from the true scope of the present invention. Additionally, many modifications may be made to adapt a particular situation to the teachings of the present invention without departing from the central inventive concept described herein. Furthermore, an embodiment of the present invention may not include all of the features described above. Therefore, it is intended that the present invention not be limited to the particular embodiments disclosed, but that the invention include all embodiments falling within the scope of the appended claims.

What is claimed is:

1. A mirroring circuit comprising:

a first branch including a first transistor in series with a first resistor;

a second branch including a second transistor in series with a second resistor; and a servo circuit for controlling current flowing in the first branch and the second branch, wherein the servo circuit includes:

a third transistor configured as a diode, a source of the third transistor being coupled to a source of the first transistor, and a drain and a gate of the third transistor being coupled to a first source generating a first reference current;

a fourth transistor having its source coupled to ground via at least a third resistor, its gate coupled to the gate of the third transistor, and its drain coupled to a gate of the first transistor and to a second source generating a second reference current;

a fifth transistor configured as a diode, a source of the fifth transistor being coupled to a source of the second transistor, and a drain and a gate of the fifth transistor being coupled to a third source generating a third reference current; and a sixth transistor having its source coupled to ground via at least the third resistor, its gate coupled to the gate of the fifth transistor, and its drain coupled to a gate of the second transistor and to a fourth source generating a fourth reference current.

2. The mirroring circuit of claim 1, wherein the first transistor and the second transistor have low stray capacitances, so as to allow operation of the mirroring circuit at high frequencies.

3. The mirroring circuit of claim 2, wherein one electrode of the first resistor, one electrode of the second resistor, and one electrode of the third resistor are coupled to ground.

4. The mirroring circuit of claim 1, wherein the first and second transistors are NMOS transistors.

5. The mirroring circuit of claim 1, wherein the first and second transistors are PMOS transistors.

6. A mirroring circuit comprising:

a first branch including a first resistor and a first transistor having a source electrode, a drain electrode, and a gate electrode, the source electrode of the first transistor being coupled to a first electrode of the first resistor, and a second electrode of the first resistor being coupled to a first reference voltage;

a second branch including a second resistor and a second transistor having a source electrode, a drain electrode, and a gate electrode, the source electrode of the second transistor being coupled to a first electrode of the second resistor, and a second electrode of the second resistor being coupled to the first reference voltage; and a servo circuit controlling source voltages of the first transistor and the second transistor, wherein the servo circuit includes:

a third transistor having a source electrode, a drain electrode, and a gate electrode, the source electrode of the third transistor being coupled to the source electrode of the first transistor, and the gate electrode and the drain electrode of the third transistor being coupled to a first source generating a first reference current;

a fourth transistor having a source electrode, a drain electrode, and a gate electrode, the source electrode of the fourth transistor being coupled to a first electrode of a third resistor that has a second electrode coupled to a second reference voltage, the gate electrode of the fourth transistor being coupled to the gate electrode of the third transistor, and the drain electrode of the fourth transistor being coupled to the gate electrode of the first transistor and to a second source generating a second reference current;

a fifth transistor having a source electrode, a drain electrode, and a gate electrode, the source electrode of the fifth transistor being coupled to the source electrode of the second transistor, and the gate electrode and the drain electrode of the fifth transistor being coupled to a third source generating a third reference current; and a sixth transistor having a source electrode, a drain electrode, and a gate electrode, the source electrode of the sixth transistor being coupled to the first electrode of the third resistor, the gate electrode of the sixth transistor being coupled to the gate electrode of the fifth transistor, and the drain electrode of the sixth transistor being coupled to the gate electrode of the second transistor and to a fourth source generating a fourth reference current, wherein the third transistor and the fourth transistor have substantially identical Vgs characteristics.

7. The mirroring circuit of claim 6, wherein the first reference current, the second reference current, the third reference current, and the fourth reference current are all substantially equal.

8. The mirroring circuit of claim 6, wherein the first transistor and the second transistor have low stray capacitances, so as to allow operation of the mirroring circuit at high frequencies.

9. The mirroring circuit of claim 8, wherein the second electrode of the first resistor, the second electrode of the second resistor, and the second electrode of the third resistor are coupled to ground.

10. The mirroring circuit of claim 6, wherein the first and second transistors are NMOS transistors.

11. The mirroring circuit of claim 6, wherein the first and second transistors are PMOS transistors.

12. An amplifier circuit having two inputs and two outputs, said amplifier circuit comprising:

a Miller gain stage having two outputs coupled to the two outputs of the amplifier circuit, wherein the Miller gain stage is supplied by a mirror current source that includes a first branch having a first transistor in series with a first resistor, a second branch having a second transistor in series with a second resistor, and a servo circuit for controlling current flowing in the first branch and the second branch, and the servo circuit includes:

a third transistor configured as a diode, a source of the third transistor being coupled to a source of the first transistor, and a drain and a gate of the third transistor being coupled to a first source generating a first reference current;

a fourth transistor having its source coupled to ground via at least a third resistor, its gate coupled to the gate of the third transistor, and its drain coupled to a gate of the first transistor and to a second source generating a second reference current;

a fifth transistor configured as a diode, a source of the fifth transistor being coupled to a source of the second transistor, and a drain and a gate of the fifth transistor being coupled to a third source generating a third reference current; and a sixth transistor having its source coupled to ground via at least the third resistor, its gate coupled to the gate of the fifth transistor, and its drain coupled to a gate of the second transistor and to a fourth source generating a fourth reference current.

13. The amplifier circuit of claim 12, wherein the first transistor and the second transistor have low stray capacitances, so as to allow operation of the amplifier circuit at high frequencies.

14. The amplifier circuit of claim 13, wherein one electrode of the first resistor, one electrode of the second resistor, and one electrode of the third resistor are coupled to ground.

15. The amplifier circuit of claim 12, wherein the first and second transistors are NMOS transistors.

16. The amplifier circuit of claim 12, wherein the first and second transistors are PMOS transistors.

17. The amplifier circuit of claim 12, wherein the first reference current, the second reference current, the third reference current, and the fourth reference current are all substantially equal.

18. An integrated circuit including at least one amplifier, said amplifier comprising:

a Miller gain stage having two outputs coupled to outputs of the amplifier, wherein the Miller gain stage is supplied by a mirror current source that includes a first branch having a first transistor in series with a first resistor, a second branch having a second transistor in series with a second resistor, and a servo circuit for controlling current flowing in the first branch and the second branch, and the servo circuit includes:

a third transistor configured as a diode, a source of the third transistor being coupled to a source of the first transistor, and a drain and a gate of the third transistor being coupled to a first source generating a first reference current;

a fourth transistor having its source coupled to ground via at least a third resistor, its gate coupled to the gate of the third transistor, and its drain coupled to a gate of the first transistor and to a second source generating a second reference current;

a fifth transistor configured as a diode, a source of the fifth transistor being coupled to a source of the second transistor, and a drain and a gate of the fifth transistor being coupled to a third source generating a third reference current; and a sixth transistor having its source coupled to ground via at least the third resistor, its gate coupled to the gate of the fifth transistor, and its drain coupled to a gate of the second transistor and to a fourth source generating a fourth reference current.

19. The integrated circuit of claim 18, wherein the first transistor and the second transistor have low stray capacitances, so as to allow operation of the amplifier circuit at high frequencies.

20. The integrated circuit of claim 18, wherein one electrode of the first resistor, one electrode of the second resistor, and one electrode of the third resistor are coupled to ground.

21. The integrated circuit of claim 18, wherein the first reference current, the second reference current, the third reference current, and the fourth reference current are all substantially equal.

* * * * *